US006419446B1

(12) United States Patent
Kvasnak et al.

(10) Patent No.: US 6,419,446 B1
(45) Date of Patent: Jul. 16, 2002

(54) APPARATUS AND METHOD FOR INHIBITING RADIAL TRANSFER OF CORE GAS FLOW WITHIN A CORE GAS FLOW PATH OF A GAS TURBINE ENGINE

(75) Inventors: William A. Kvasnak, Guilford, CT (US); Friedrich O. Soechting, Tequesta, FL (US); Karen A. Thole, Blacksburg, VA (US); Gary A. Zess, New Britain, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/468,751

(22) Filed: Dec. 21, 1999

Related U.S. Application Data

(60) Provisional application No. 60/147,282, filed on Aug. 5, 1999.

(51) Int. Cl.[7] ..... F01D 9/04

(52) U.S. Cl. ..... 415/191; 415/116; 415/208.2; 415/210.1; 415/914; 416/228; 416/235; 416/236 R; 416/237

(58) Field of Search ..... 415/191, 208.1, 415/208.2, 210.1, 914, 115, 116; 416/96 R, 96 A, 97 R, 193 A, 228, 235, 236 R, 237

(56) References Cited

U.S. PATENT DOCUMENTS

| | | | | | |
|---|---|---|---|---|---|
| 4,208,167 | A | * | 6/1980 | Yasugahira et al. | 415/210.1 |
| 5,846,048 | A | * | 12/1998 | Tomita et al. | 415/115 |
| 6,126,400 | A | * | 10/2000 | Nichols et al. | 416/241 B |

FOREIGN PATENT DOCUMENTS

| | | | | | |
|---|---|---|---|---|---|
| EP | 178242 | A | * | 4/1986 | 416/97 R |
| FR | 781057 | A | * | 5/1935 | 416/97 R |
| GB | 504214 | A | * | 4/1939 | 415/914 |
| GB | 2042675 | A | * | 9/1980 | 415/915 |
| JP | 52-74706 | A | * | 6/1977 | 415/914 |

OTHER PUBLICATIONS

"The Influence of a Horseshoe Vortex on Local Convective Heat Transfer", E. M. Fisher and P. A. Eibeck, Journal of Heat Transfer, May 1990, vol. 112/329–112/335.

"Iceformation Design of a Cylinder/Hull Juncture with Horseshoe Vortices and Unsteady Wake", R. S. LaFleur and L. S. Langston, pp. 87–97.

"Lecture I—Simulation Codes for Calculation of Heat Transfer to Convectively–Cooled Turbine Blades", M. E. Crawford (1986), pp. I–1–I–27 together with 2 sheets of drawings and a list of References.

(List continued on next page.)

*Primary Examiner*—Christopher Verdier
(74) *Attorney, Agent, or Firm*—Richard D. Getz; Brian J. Hamilla

(57) ABSTRACT

A method for inhibiting radial transfer of core gas flow away from a center radial region and toward the inner and outer radial boundaries of a core gas flow path within a gas turbine engine is provided that includes the steps of: (1) providing a flow directing structure that includes an airfoil that abuts a wall surface, said airfoil having a leading edge, a pressure side, and a suction side; and (2) increasing the velocity of the core gas flow in the area where the leading edge of the airfoil abuts the wall. Increasing the velocity of the core gas flow in the area where the leading edge of the airfoil abuts the wall impedes the formation of a pressure gradient along the surface of the airfoil that forces core gas from the center region of the core gas toward the wall. The apparatus includes apparatus for diverting core gas flow away from the area where the airfoil abuts the wall.

28 Claims, 2 Drawing Sheets

OTHER PUBLICATIONS

"Horseshoe Vortex Control by Suction Through a Slot in the Wall Cylinder Junction", D. P. Georgiou and V. A. Papavassilipoulos, 3rd European Conference on Turbomachinery, Fluid Mechanics and Thermodynamics, London, England, Mar. 2–5, 1999, pp. 429–439.

"Heat Transfer in the Vicinity of a Large–Scale Obstruction in a Turbulent Boundary Layer", M. F. Blair, J. Propulsion, vol. 1, No. 2, pp. 158–160.

"Predictions of Endwall Losses and Secondary Flows in Axial Flow Turbine Cascades", O. P. Sharma, T. L. Butler, Journal of Turbomachinery, Apr. 1987, vol. 109, pp. 229–236.

Crossflows in a Turbine Cascade Passage:, L. S. Langston, Transactions of the ASME, vol. 102, Oct. 1980, pp. 866–874.

"Heat Transfer Effects of a Longitudinal Vortex Embedded in a Turbulent Boundary Layer", P. A. Eibeck, J. K. Eaton, Transaction of the ASME, vol. 109, Feb. 1987, pp. 16–24.

"Three–Dimensional Flow within a Turbine Cascade Passage", L. S. Langston, M. L. Nice, R. M. Hooper, Journal of Engineering for Power, Jan. 1977, pp. 21–28.

Study of Mean– and Turbulent–Velicity in a Large–Scale Turbine–Vane Passsage, D. A. Bailey, Transactions of the ASME, vol. 102, Jan. 1980, pp. 88–95.

"Horseshoe Vortex Formation Around a Cylinder", W. A. Eckerle, L. S. Langston, Transactions of ASME, vol. 109, Apr. 1987, pp. 278–285.

Geometry Modification Effects on a Junction Vortex Flow, F. J. Peirce, G. A. Frangistas, D. J. Nelson, Virginia Polytechnic Institute and State university, Blacksburg, Virginia 24061, pp. 37–44.

Juncture Flow Control Using Leading–Edge Fillets, L. R. Kubendran and W. D. Harvey, AIAA 3rd Applied Aerodynamics Conference, Oct. 14–16, 1985, Colorado Springs, Colorado, cover sheet and pp. 1–5.

On the effect of a Strake–Like Junction Fillet on the Lift and Drag of a Wing, L. Bernstein and S. Hamid, Queen Mary and Westfield College, University of London, pp. 39–52.

Control of Horseshoe Vortex Juncture Flow Using a Fillet, Chao–Ho Sung and Chen–I Yang, David Taylor Research Center, Bethesda, Maryland 20084–5000 and L. R. Kubendran, NASA Langley Research Center, Hampton, Virginia 23665, pp. 13–20.

Effects of a Fillet on the Flow Past a Wing Body Junction, W. J. Devenport, M. B. Dewitz, N. K. Agarwal, R. LO. Simpson, and K. Poddar,, AIAA 2nd Shear Flow Conference, Mar. 13–16, 1989/ Temple, AZ, cover sheet and pp. 1–11.

* cited by examiner

APPARATUS AND METHOD FOR INHIBITING RADIAL TRANSFER OF CORE GAS FLOW WITHIN A CORE GAS FLOW PATH OF A GAS TURBINE ENGINE

This application claims the benefit of U.S. Provisional Application No. 60/147,282, filed Aug. 5, 1999.

BACKGROUND OF THE INVENTION

1. Technical Field

This invention relates to flow directing structures used within gas turbine engines in general, and to methods and apparatus for inhibiting radial transfer of core gas flow within a core gas flow path in particular.

2. Background Information

A gas turbine engine includes a fan, a compressor, a combustor, and a turbine disposed along a common longitudinal axis. The fan and compressor sections work the air drawn into the engine, increasing the pressure and temperature of the air. Fuel is added to the worked air and the mixture is burned within the combustor. The combustion products and any unburned air subsequently power the turbine and exit the engine producing thrust. The compressor and turbine include a plurality of rotor assemblies and a stationary vane assemblies. Rotor blades and stator vanes are examples of structures (i.e., "flow directing structures") that direct core gas flow within a gas turbine engine. Air entering the compressor and traveling aft through the combustor and turbine is typically referred to as "core gas". In and aft of the combustor and turbine, the core gas further includes cooling air entering the flow path and the products of combustion products.

In and aft of the combustor, the high temperature of the core gas requires most components in contact with the core gas be cooled. Components are typically cooled by passing cooling air through the component and allowing it to exit through passages disposed within an external wall of the component. Another cooling technique utilizes a film of cooling air traveling along the surface of a component. The film of cooling air insulates the component from the high temperature core gas and increases the uniformity of cooling along the component surface.

Core gas temperature can vary significantly within the core gas flow path, particularly in the first few stages of the turbine aft of the combustor. On the one hand, core gas temperature decreases as the distance from the combustor increases. On the other hand, core gas temperature typically varies as a function of radial position within the core gas flow path. At a given axial position, the highest core gas temperatures are typically found in the center radial region of the core gas path and the lowest at the core gas path radial boundaries.

Core gas flow anomalies can shift the "hottest" core gas flow away from the center region of the core gas flow path, toward the liners or platforms that form the core gas inner and outer radial boundaries. An example of such a flow anomaly is a "horseshoe vortex" that typically forms where an airfoil abuts a surface; e.g., the junction of the airfoil and platform of a stator vane. The horseshoe vortex begins along the leading edge area of the airfoil traveling away from the center region, toward a wall that forms one of the gas path radial boundaries. The vortex next rolls away from the airfoil and travels along the wall against the core gas flow, subsequently curling around to form the namesake flow pattern. The higher temperature center region core gas flow diverted into close proximity with the wall detrimentally affects the useful life of the wall.

Another example of such a flow anomaly is a "passage vortex" that develops in the passage between adjacent airfoils in a stator or rotor section. The passage vortex is an amalgamation of the pressure side portion of the horseshoe vortex, core gas crossflow between adjacent airfoils, and the entrained air from the freesteam core gas flow passing between the airfoils. Collectively, these flow characteristics encourage some percentage of the flow passing between the airfoils to travel along a helical path (i.e., the "passage vortex") that diverts core gas flow from the center of the core gas path toward one or both radial boundaries of the core gas path. As in those cases where a horseshoe vortex is present, the higher temperature center core gas flow traveling in close proximity to the walls that form the core gas path radial boundaries detrimentally affects their useful life.

What is needed, therefore, is an apparatus and a method for inhibiting radial transfer of high temperature core gas away from the center radial region of the core gas flow path and toward the inner and outer radial boundaries of the core gas flow path.

DISCLOSURE OF THE INVENTION

It is, therefore, an object of the present invention to provide an apparatus and a method for inhibiting radial transfer of high temperature core gas flow away from the center radial region of a core gas flow path within a gas turbine engine and toward the inner and outer radial boundaries of the core gas flow path.

A method for inhibiting radial transfer of core gas flow away from a center radial region and toward the inner and outer radial boundaries of a core gas flow path within a gas turbine engine is provided that includes the steps of: (1) providing a flow directing structure that includes an airfoil that abuts a wall, said airfoil having a leading edge, a pressure side, and a suction side; and (2) increasing the velocity of the core gas flow in the area where the leading edge of the airfoil abuts the wall. Increasing the velocity of the core gas flow in the area where the leading edge of the airfoil abuts the wall impedes the formation of a pressure gradient along the leading edge area of the airfoil that forces core gas from the center region of the core gas path toward the wall. The apparatus includes means for diverting core gas flow away from the area where the leading edge of the airfoil abuts the wall.

One of the advantages of the present invention is that undesirable high temperature core gas flow from the center region of the core gas path is inhibited from migrating toward the walls that form the inner and outer radial core gas path boundaries. High temperature core gas in close proximity to the walls can detrimentally affect the useful life of the wall. Another advantage of the present invention is that it may be possible to decrease the amount of cooling air necessary to cool the wall. In a conventional stator vane or rotor blade (e.g., examples of flow directing structures), it is known to provide substantial cooling in the wall to counteract the effects of the core gas flow anomaly. Using the present invention, the core gas flow anomaly that forces hot core gas from the center region of the path toward the wall is inhibited. As a result, it may be possible to use less cooling air to satisfactorily cool the wall.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
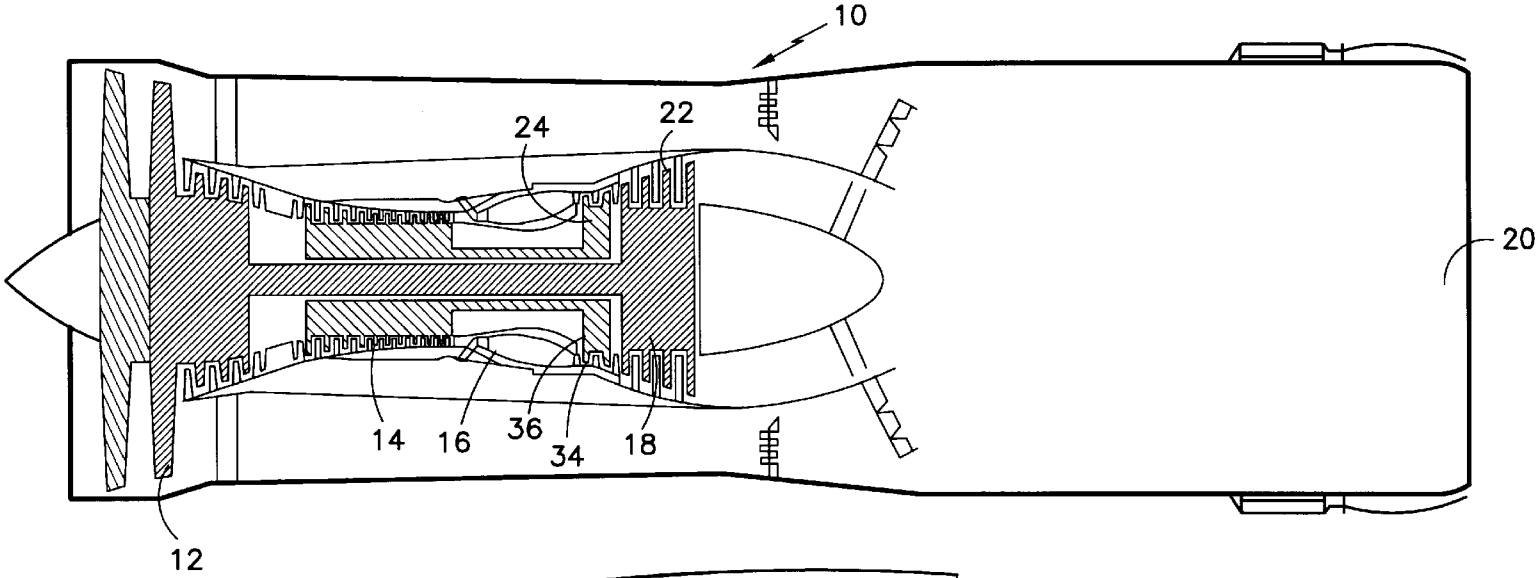
FIG. 1 is a diagrammatic view of a gas turbine engine.
Figure 2:
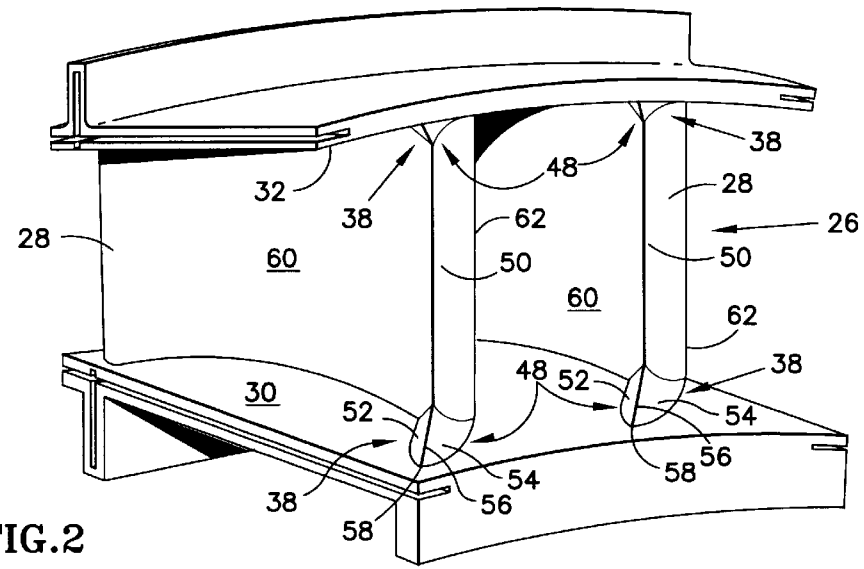
FIG. 2 is a diagrammatic perspective view of a stator vane.

Referring to FIGS. 1 and 2, a gas turbine engine 10 includes a fan 12, a compressor 14, a combustor 16, a turbine 18 and a nozzle 20. The turbine 18 includes a plurality of stator vane stages 22 and rotor stages 24. Each stator vane stage 22 guides air into or out of a rotor stage 24 in a manner designed in part to optimize performance of that rotor stage. A stator vane stage 22 includes a plurality of stator vane segments 26 (see FIG. 2), each including at least one airfoil 28 extending between an inner platform 30 and an outer platform 32. Collectively, the platforms 30,32 form the inner and outer radial gas path boundaries of the stator vane portion of the annular core gas path. A rotor stage 24 (see FIG. 1) includes a plurality of rotor blades 34 attached to a rotor disk 36. Each rotor blade (as is known in the art) includes a root, an airfoil, and a platform extending laterally outward between the root and the airfoil. A liner (not shown) is typically disposed radially outside the rotor stage. The rotor blade platforms and the liner form the inner and outer radial gas path boundaries of the rotor portion of the annular core gas path. The text below describes the present apparatus and method generically in terms of an airfoil and wall and specifically in terms of a stator vane. The present apparatus and method for inhibiting radial transfer of core gas flow within a core gas flow path is applicable, but not limited to, stator vanes 26, rotor blades 34, and other types of flow directing structures useful within a gas turbine engine 10.

The present method for inhibiting radial transfer of core gas flow within a core gas flow path includes the steps of: (1) providing a flow directing structure having an airfoil that abuts at least one wall that acts as a radial boundary of the core gas path; and (2) increasing the velocity of the core gas flow in the area where the leading edge of the airfoil abuts the wall. Increasing the velocity of the core gas flow in the area where the leading edge of the airfoil abuts the wall inhibits the formation of a pressure gradient along the surface of the airfoil that forces core gas flow from the center region of the core gas path in a direction toward the wall.

Figure 4:
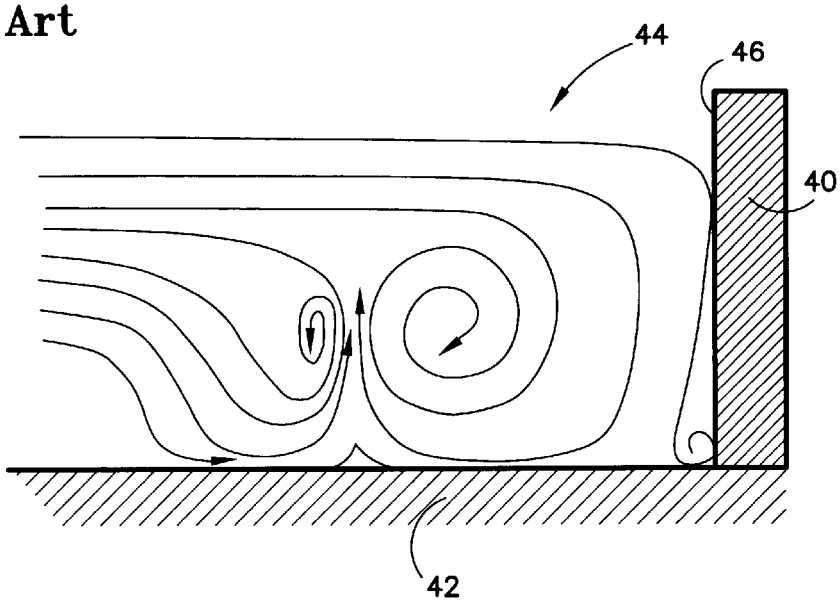
FIG.4 Prior Art
FIG. 4 shows a typical core gas flow pattern in the area where the leading edge of an airfoil abuts a wall in a conventional manner.

The step of increasing the velocity of the core gas flow in the area where the leading edge of the airfoil abuts the wall preferably utilizes a means 38 for diverting core gas flow. Core gas flow encountering a conventional airfoil 40 (shown diagrammatically in FIG. 4) will vary in velocity depending on its position in the core gas path. The highest velocity core gas typically travels in the center radial region of the path and the lowest velocity core gas (zero) is found on the surface of the radial boundary walls 42 of the path. The difference in core gas velocity is at least partially attributable to cooling air entering the core gas path along the walls that form the radial boundaries and boundary layer effects that are contiguous with those boundary walls. Because total pressure is a function of core gas velocity, the difference in core gas velocity creates a pressure gradient extending from the center region of the core gas path to the path wall 42. The pressure gradient, in turn, acts on a portion of the core gas flow, forcing that portion into a secondary flow directed toward the wall 42. The resultant flow anomaly assumes the form of a horseshoe vortex 44 (see FIG. 4) in the area where the leading edge 46 of the airfoil 40 abuts the wall 42. After forming at the leading edge 46, the horseshoe vortex will divide and send a portion of the vortex along the suction side of the airfoil 40 and the remaining portion along the pressure side of the airfoil 40.

Now referring to FIG. 2, using the present method, the means 38 for diverting core gas flow is used to divert the high temperature core gas flow away from the area where the leading edge of the airfoil 28 abuts the wall (i.e., platform) 30,32. Diverting the core gas flow away from the area where the leading edge of the airfoil 28 abuts the wall 30,32 causes the core gas flow to increase in velocity, thereby decreasing the magnitude of the pressure gradient and the concomitant secondary core gas flow in the direction of the path wall 30,32.

The diverting means 38 can be any mechanical or fluid device capable of diverting core gas flow away from the junction between the airfoil 28 and wall 30,32. In one embodiment, the means 38 for diverting core gas flow is a fillet 48 that extends lengthwise out from the leading edge 50 of the airfoil 28 and heightwise along the leading edge 50 of the airfoil 28. The fillet 48 has a pressure side 52 and a suction side 54 that meet each other at a dividing plane 56. The dividing plane 56 is aligned with a stagnation line location typical of the intended operating environment of the airfoil. The pressure side 52 of the fillet 48 is arcuately shaped, beginning at the outer edge 58 of the fillet 48 and extending back a distance down the pressure side 60 of the airfoil 28. The suction side 54 of the fillet 48 is also arcuately shaped, beginning at the outer edge 58 of the fillet 48 and extending back a distance down the suction side 62 of the airfoil 28. The suction side 54 of the fillet 48 extends out from the dividing plane 56 farther than the pressure side 52 of the fillet 48 extends out from the dividing plane 56. The length of the fillet 48 is preferably greater than the height of the fillet 48.

Figure 3:
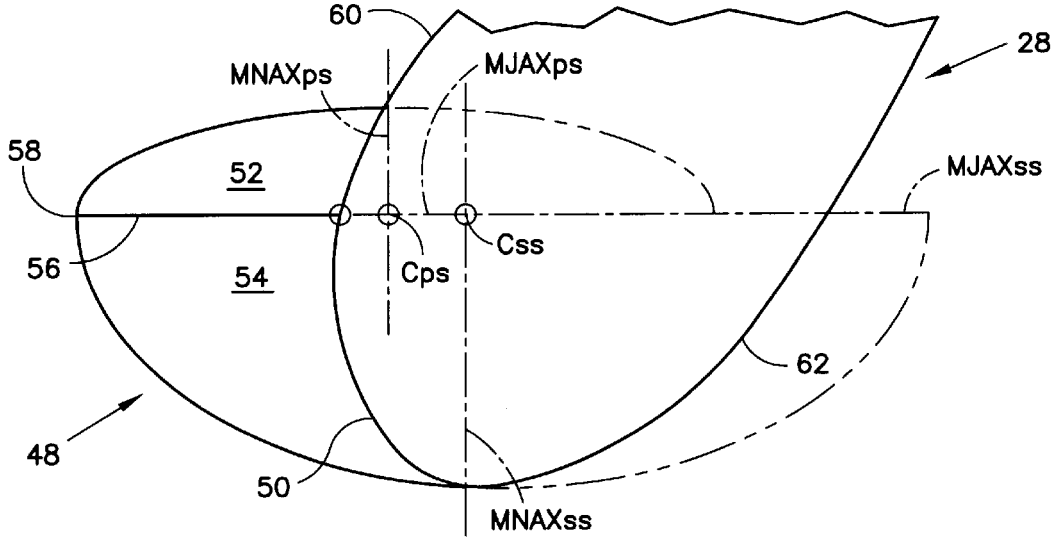
FIG. 3 is a diagrammatic top view of an airfoil and a preferred embodiment of a fillet.

Referring to FIG. 3, in a preferred embodiment the suction side 54 and pressure side 52 of the fillet 48 are substantially elliptical in shape. The suction side 54 is characterized by an elliptical center point ($C_{SS}$), a minor axis ($MNAX_{SS}$), and a major axis ($MJAX_{SS}$). The pressure side 52 is characterized by an elliptical center point ($C_{PS}$), a minor axis ($MNAX_{PS}$) and a major axis ($MJAX_{PS}$). The major axes of the pressure side 52 and suction side 54 of the fillet 48 are substantially aligned with the dividing plane 56. The major axis of the suction side 54 is greater than the major axis of the pressure side 52 ($MJAX_{SS}>MJAX_{PS}$). The minor axis of the suction side 54 is greater than the minor axis of the pressure side 52 ($MNAX_{SS}>MNAX_{PS}$). The elliptically shaped suction side 54 and pressure side 52 of the fillet 48 smoothly transition into one another at the outer edge 58 of the fillet 48 The preferred way to accomplish the smooth transition is to separate the elliptical centers of the suction side 54 and pressure side 52 ($C_{SS}$,$C_{PS}$) along the dividing plane 56 such that at the intersection point between the two sides 52,54, each elliptical side 52, 54 has substantially the same slope as the other elliptical side 54,52. It is our experience that the elliptical shapes of the suction side 54 and pressure side 52 of the fillet 48 and their relative positioning, as described above, provide a diverting means with an appreciable performance advantage over symmetrical fillets under similar operating circumstances.

In another embodiment, the diverting means 38 is an aerodynamic bluff body that diverts air in a manner similar to the fillet 48. The bluff body is created by jetting air into the region in front of the airfoil. One or more high-energy jets of air deflect the core gas flow causing it to divert around the leading edge. In all cases, the diverting means diverts the core gas flow in the area of the junction away from the junction consequently causing that core gas flow to increase in velocity.

Although this invention has been shown and described with respect to the detailed embodiments thereof, it will be understood by those skilled in the art that various changes in form and detail thereof may be made without departing from the spirit and scope of the claimed invention. For example, in those instances where a flow directing device within a gas turbine engine has more than one airfoil/wall junction (e.g., a stator vane airfoil bounded by inner and outer radial platforms), a diverting means can be used at the junctions between the airfoil and both the inner and outer radial walls.

What is claimed is:

1. A method for inhibiting radial transfer of core gas flow within a core gas flow path of a gas turbine engine, comprising the steps of:

providing a flow directing structure having an airfoil that abuts a wall, said airfoil having a leading edge, a pressure side, a suction side; and increasing a velocity of said core gas flow in an area where said leading edge of said airfoil abuts said wall with a fillet between said wall and said airfoil, said fillet extending generally from said leading edge of said airfoil and having a dividing plane aligned with a stagnation line of said airfoil;

wherein increasing said core gas flow velocity in said area inhibits formation of a secondary flow of core gas flow in the direction of said wall.

2. The method of claim 1, comprising the further step of:

increasing said core gas flow velocity in an area where said airfoil abuts said wall along a portion of said pressure side of said airfoil.

3. The method of claim 1, comprising the further step of:

increasing said core gas flow velocity in an area where said airfoil abuts said wall along a portion of said suction side of said airfoil.

4. The method of claim 1, wherein said fillet diverts said core gas flow away from said area where said leading edge of said airfoil abuts said wall.

5. A method for inhibiting radial transfer of core gas flow within a core gas flow path of a gas turbine engine, comprising the steps of:

providing a flow directing structure having an airfoil that abuts a wall, said airfoil having a leading edge, a pressure side and a suction side; and disposing a fillet in an area where said airfoil abuts said wall to increase a velocity of said core gas flow at said area for inhibiting formation of a secondary flow of core gas flow in the direction of said wall, wherein said fillet comprises:

a substantially elliptically shaped suction side; and a substantially elliptically shaped pressure side;

wherein said pressure side and suction side of said fillet meet at a dividing plane.

6. The method of claim 5, wherein said suction side of said fillet includes a major axis, a minor axis, and an elliptical centerpoint; and said pressure side of said fillet includes a major axis, a minor axis, and an elliptical centerpoint;

wherein said major axis of said suction side of said fillet is greater than said major axis of said pressure side of said fillet; and wherein said minor axis of said suction side of said fillet is greater than said minor axis of said pressure side of said fillet.

7. The method of claim 6, wherein said elliptical centerpoint of said suction side of said fillet is separated from said elliptical center point of said pressure side of said fillet.

8. The method of claim 5, wherein said suction side of said fillet has an elliptical centerpoint and said pressure side of said fillet has an elliptical centerpoint, and said elliptical centerpoint of said suction side of said fillet is separated from said elliptical center point of said pressure side of said fillet.

9. The method of claim 5, wherein said dividing plane is substantially aligned with a stagnation line of said airfoil.

10. A stator vane, comprising:

an airfoil having a leading edge, a pressure side, and a suction side;

a platform abutting said airfoil; and a fillet between said platform and said leading edge of said airfoil for increasing a core gas flow velocity in an area where said leading edge of said airfoil abuts said platform;

wherein said fillet has a dividing plane aligned with a stagnation line of said airfoil.

11. A stator vane, comprising:

an airfoil having a leading edge, a pressure side, and a suction side;

a platform abutting said airfoil; and a fillet disposed at a junction of said leading edge of said airfoil and said platform, generally extending out from said leading edge of said airfoil, and having a dividing plane aligned with a stagnation line of said airfoil.

12. A stator vane, comprising:

an airfoil having a leading edge, a pressure side, and a suction side;

a platform abutting said airfoil; and a fillet disposed where said airfoil abuts with said platform to inhibit a secondary core gas flow along said leading edge in the direction of said platform, wherein said fillet comprises:

a substantially elliptically shaped suction side; and a substantially elliptically shaped pressure side;

wherein said pressure side and suction side of said fillet meet at a dividing plane.

13. The stator vane of claim 12, wherein said suction side of said fillet includes a major axis, a minor axis, and an elliptical centerpoint; and said pressure side of said fillet includes a major axis, a minor axis, and an elliptical centerpoint;

wherein said major axis of said suction side of said fillet is greater than said major axis of said pressure side of said fillet, and wherein said minor axis of said suction side of said fillet is greater than said minor axis of said pressure side of said fillet.

14. The stator vane of claim 13, wherein said elliptical centerpoint of said suction side of said fillet is separated from said elliptical center point of said pressure side of said fillet.

15. The stator vane of claim 12, wherein said suction side of said fillet has an elliptical centerpoint and said pressure side of said fillet has an elliptical centerpoint, and said elliptical centerpoint of said suction side of said fillet is separated from said elliptical center point of said pressure side of said fillet.

16. The stator vane of claim 12, wherein said dividing plane is substantially aligned with a stagnation line of said airfoil.

17. A stator vane, comprising:

an airfoil having a leading edge, a pressure side, and a suction side;

a platform abutting said airfoil; and a fillet disposed where said airfoil abuts with said platform to inhibit a secondary core gas flow along said leading edge in the direction of said platform, wherein said fillet comprises:

an arcuately shaped suction side; and an arcuately shaped pressure side;

wherein said pressure side and suction side of said fillet meet at a dividing plane.

18. The stator vane of claim 17, wherein said suction side of said fillet extends out from said dividing plane a first distance, and said pressure side of said fillet extends out from said dividing plane a second distance, wherein along a line perpendicular to said dividing plane, said first distance is greater than said second distance.

19. The stator vane of claim 18, wherein said dividing plane is substantially aligned with a stagnation line of said airfoil.

20. A flow directing device for use in a gas turbine engine, comprising:

an airfoil having a leading edge, a pressure side, and a suction side;

a wall abutting said airfoil; and a fillet disposed between said airfoil and said wall, generally extending out from said leading edge of said airfoil for inhibiting a secondary core gas flow along said leading edge in the direction of said wall, and having a dividing plane aligned with a stagnation line of said airfoil.

21. A method for cooling a stator vane exposed to high temperature core gas flow, comprising the steps of providing a stator vane having an airfoil joined to a platform at a junction, said airfoil having a leading edge, a trailing edge, a pressure side, and a suction side; and diverting said high temperature core gas flow away from said junction at said leading edge of said stator vane with a fillet disposed between said platform and said leading edge of said stator vane, said fillet having a dividing planed aligned with a stagnation line of said airfoil;

wherein diverting said core gas flow away from said junction impedes formation of a secondary flow of high temperature core gas along said airfoil toward said platform, said secondary flow undesirably moving high temperature core gas in close proximity to said platform.

22. The flow directing device as recited in claim 20, wherein said fillet has a length and a height, said length greater than said height.

23. A flow directing device for use in a gas turbine engine, comprising:

an airfoil having a leading edge, a pressure side, and a suction side;

a wall abutting said airfoil; and a fillet disposed between said airfoil and said wall, said fillet including:

a substantially elliptically shaped suction side; and a substantially elliptically shaped pressure side;

wherein said pressure side and said suction side of said fillet meet at a dividing plane.

24. The flow directing device as recited in claim 23, wherein said fillet has a length and a height, said length greater than said height.

25. A flow directing device for use in a gas turbine engine, comprising:

an airfoil having a leading edge, a pressure side, and a suction side;

a wall abutting said airfoil: and a fillet disposed between said airfoil and said wall, said fillet including:

an arcuately shaped suction side; and an arcuately shaped pressure side;

wherein said pressure side and said suction side of said fillet meet at a dividing plane.

26. The flow directing device as recited in claim 25, wherein said fillet has a length and a height, said length greater than said height.

27. A vane segment, comprising:

at least one platform;

a plurality of flow directing devices, each one of said flow directing devices extending from said at least one platform and having a leading edge, and a plurality of fillets, each one of said fillets disposed at a junction between said platform and a corresponding one said flow directing devices, extending generally from said leading edge of said flow directing device, and having a dividing plane aligned with a stagnation line of said flow directing device.

28. The vane segment as recited in claim 27, wherein said at least one platform comprises two platforms.

* * * * *